US005709575A

United States Patent [19]

Betrock

[11] Patent Number: 5,709,575

[45] Date of Patent: Jan. 20, 1998

[54] PRACTICE SWIM FIN WITH PERFORATIONS

[76] Inventor: Irving Betrock, 14001 E. Palomino Dr., Fort Lauderdale, Fla. 33330

[21] Appl. No.: 805,765

[22] Filed: Feb. 25, 1997

[51] Int. Cl.[6] ..... A63B 31/08

[52] U.S. Cl. ..... 441/64; D21/239

[58] Field of Search ..... 441/61–64; D21/239

[56] References Cited

U.S. PATENT DOCUMENTS

| | | | |
|---|---|---|---|
| 915,457 | 3/1909 | Marrotte . | |
| 2,099,973 | 11/1937 | De Corlieu | 9/21 |
| 2,588,363 | 3/1952 | De Corlieu | 9/21 |
| 2,672,629 | 3/1954 | La Trell | 9/21 |
| 3,422,470 | 1/1969 | Mares | 441/64 |
| 3,908,213 | 9/1975 | Hill | 441/64 |
| 4,627,820 | 12/1986 | Penebre | 441/64 |
| 4,948,385 | 8/1990 | Hull | 441/64 |
| 5,108,328 | 4/1992 | Hull | 441/64 |

FOREIGN PATENT DOCUMENTS

| | | | |
|---|---|---|---|
| 2314738 | 1/1977 | France | 441/64 |
| 2459057 | 2/1981 | France | 441/64 |

*Primary Examiner*—Ed L. Swinehart
*Attorney, Agent, or Firm*—Alvin S. Blum

[57] ABSTRACT

A practice molded rubbery swim fin has a foot retaining section with a heel and toe portion and a tapered blade section extending outward from the toe portion a distance of two to five inches. A number of apertures perforate the blade to reduce hydrodynamic resistance. Side stiffening ridges extend part way down the blade, leaving the distal end of the blade free to flex. This fin enables the swimmer to move fast enough to simulate the more vigorous kicking of racing without as much effort. The structure reduces stress on the swimmer in practice.

3 Claims, 1 Drawing Sheet

PRACTICE SWIM FIN WITH PERFORATIONS

BACKGROUND OF THE INVENTION

Field of the Invention

This invention relates to swimming accessories, and more particularly to swim fins for training swimmers for competitive swimming.

There are distinct advantages for an athlete to train and practice the sport under physical conditions that closely approximate those that will be encountered in competition. This is true of swimming, in which the velocity achieved in competition positions the upper body at a different elevation and angle to the surface than the usual velocity achieved during training. U.S. Pat. Nos. 4,948,385 and 5,108,328 issued to Hull discuss the problem and disclose the use of swim fins to propel the body at racing velocities with excessive effort. Swim fins with long blades give excessive resistance so that the kicking stroke rate cannot match racing kick stroke rates. He teaches use of a fin with a shorter blade so that a faster kick rate can be used. However, use of his fins puts excessive strain on foot, leg, and back muscles compared to competitive kicking without fins. This may be related to the excessive resistance so far from the foot that changes the force vectors encountered during kicking.

Before Hull, swim fins with short blades of various configurations were well known in the art, as exemplified by U.S. Pat. Nos. 2,588,363; 2,672,629; 2,099,973; and 915,457. Many of these fins have a ratio of blade area to foot area corresponding to the range claimed by Hull. None of them have a structure that would overcome the problems encountered with using short blade fins at racing stroke rates.

SUMMARY OF THE INVENTION

It is accordingly an object of the invention to provide a swim fin that will enable a swimmer in training to achieve racing velocities while kicking at racing stroke rates without applying excessive effort. It is a further object that the fin be so configured that it avoids excessive resistance and unnatural force angles and stress and strain on the foot and legs.

The swim fin of the invention has a foot section for retaining the fin on the user's foot and a blade section extending outward from the foot section at the toe end at least two inches to five inches. The blade portion is made flexible and is provided with a plurality of apertures so as to reduce the hydrodynamic resistance presented by the blade.

These and other objects, features and advantages of the invention will become better understood when the following detailed description is considered in conjunction with the drawings, in which like parts are given like reference characters.

DETAILED DESCRIPTION OF PREFERRED EMBODIMENT

Figure 1:
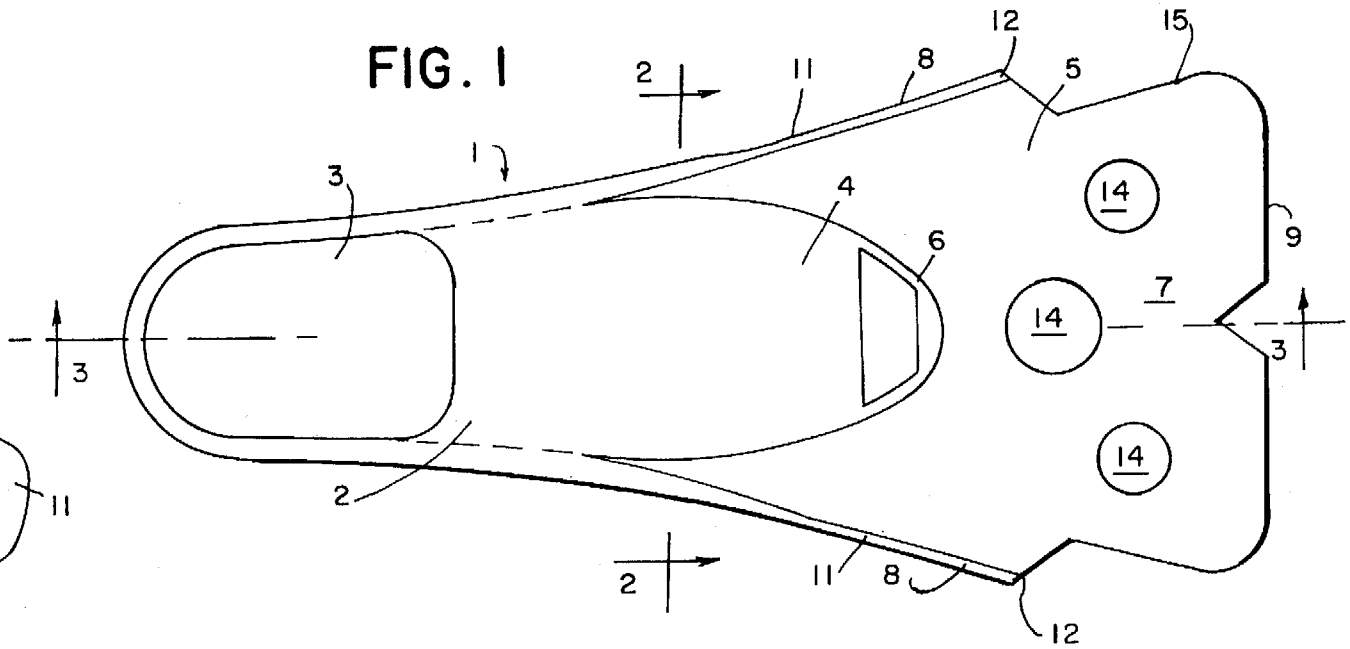
FIG. 1 is a top view of the fin in accordance with the invention.
Figure 2:
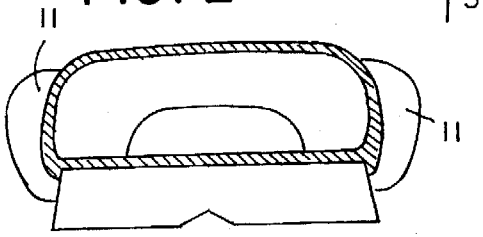
FIG. 2 is a sectional view taken through line 2—2 of FIG. 1.
Figure 3:
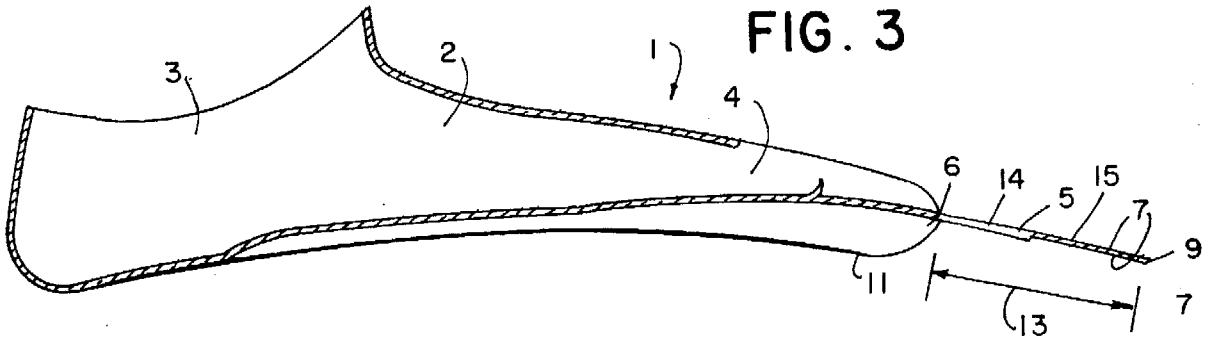
FIG. 3 is a sectional view taken through line 3—3 of FIG. 1.

Referring now to the drawing figures, the practice fin 1 of the invention is preferably made of a resilient rubbery elastomer such as a one piece molded polyurethane rubber. The fin comprises a foot section 2 having a heel portion 3 and a toe portion 4 of conventional design arranged for retaining the fin on a swimmer's foot during vigorous kicking in swimming practice. A thin flat blade section 5 is joined to the foot section 2 and extends outward from the toe portion a distance 13 from the junction 6 with the foot section. That distance is preferably from about two inches to about five inches.

The blade section 5 is comprised of two opposed broad faces 7 that taper, being wider at the free end 9 of the blade and narrower at the junction 6 with the foot section 2. The blade is provided with a plurality of apertures 14 extending between the broad faces 7. These holes or apertures reduce the hydrodynamic resistance of the blade so that the swimmer may kick at the racing rate without excessively stressing the body. The apertures further increase the flexibility of the blade end so that its angle to the water is better suited to the foot and leg anatomy, thereby reducing stress on the swimmer in practice while moving the body fast enough that the upper body encounters conditions that mimic those that actually occur during racing. This is achieved without the need for the forceful and exhausting kicking of racing by use of these fins. Consequently, the swimmer may spend more time in practice more closely simulating racing without exhaustion.

The blade may be provided along the side edges 8 with marginal stiffening ridges 11. These ridges extend from the toe portion to a point 12 before the apertures intermediate the toe portion and the free end 9 of the blade section. They leave the distal terminal portion 15 of the blade, in which the apertures 14 are located, free to flex more than that stiffened by the ridges 11.

By careful adjustment of the distance 13 that the blade extends, the distance the ridges 11 extend and the size and amount of the apertures 14, the fin may be balanced to suit the requirements of various swimming applications.

The above disclosed invention has a number of particular features which should preferably be employed in combination although each is useful separately without departure from the scope of the invention. While i have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

What is claimed is:

1. A practice fin for swimming comprising:

a foot section having a heel portion and a toe portion and means for retaining a user's foot to the fin;

a blade section attached to the foot section at the toe portion and extending outward therefrom a distance of from about two inches to about five inches, the blade section having opposed side edges, a free end, opposed broad faces, a distal blade area, and a plurality of apertures extending between the broad faces in the distal blade area outward of the toe portion, the apertures substantially reducing the hydrodynamic resistance of the distal blade area and increasing the flexibility of the distal blade area and in which the blade section is provided with marginal stiffening ridges along the opposed side edges, the ridges extending from the toe portion to a point before the aperatures.

2. The practice fin according to claim 1, in which the broad faces of the blade section are tapered, being narrower at the junction of the blade section and the foot section and wider at the free end opposite the junction.

3. The practice fin according to claim 2, in which the blade section is provided with marginal stiffening ridges along the opposed side edges, the ridges extending from the toe portion to a point intermediate said toe portion and said free end.

* * * * *